US010874223B1

(12) United States Patent
Wylie

(10) Patent No.: US 10,874,223 B1
(45) Date of Patent: Dec. 29, 2020

(54) TRACK-GUIDED MOBILITY SEAT

(71) Applicant: Janet Wylie, Washington, DC (US)

(72) Inventor: Janet Wylie, Washington, DC (US)

( * ) Notice: Subject to any disclaimer, the term of this patent is extended or adjusted under 35 U.S.C. 154(b) by 86 days.

(21) Appl. No.: 16/391,420

(22) Filed: Apr. 23, 2019

(51) Int. Cl.
*A47C 9/02* (2006.01)
*A61H 3/04* (2006.01)
*A61H 3/00* (2006.01)

(52) U.S. Cl.
CPC ..... *A47C 9/022* (2013.01); *A61H 3/04* (2013.01); *A61H 2003/002* (2013.01); *A61H 2003/043* (2013.01)

(58) Field of Classification Search
CPC .... A47C 9/022; A61H 3/04; A61H 2003/002; A61H 2003/043
USPC ..... 297/344.24
See application file for complete search history.

(56) References Cited

U.S. PATENT DOCUMENTS 2,507,887 A * 5/1950 Cheney ..... B66B 9/0815 187/201
4,555,138 A 11/1985 Hughes
5,230,405 A * 7/1993 Bartelt ..... B66B 9/0815 187/201
5,533,594 A 7/1996 Tramblay
5,632,521 A 5/1997 Archambault
5,709,154 A * 1/1998 Schott ..... B61C 11/04 104/93
5,967,265 A * 10/1999 Bruno ..... B66B 9/0838 187/201
D489,859 S 5/2004 Yamada
7,112,022 B1 * 9/2006 McLoughlin ..... B60P 7/16 410/156
7,225,899 B2 * 6/2007 Molnar ..... B66B 9/0807 187/201
8,714,170 B1 * 5/2014 Bonne ..... A61H 3/04 135/66
9,027,978 B2 5/2015 Bourgraf
2012/0048652 A1 * 3/2012 DiGiovanni ..... B66B 9/0846 187/201
2016/0058635 A1 * 3/2016 Murphy ..... A61G 7/1042 104/287
2017/0020248 A1 * 1/2017 Wood ..... A61H 3/02
2017/0087392 A1 3/2017 Lambert

FOREIGN PATENT DOCUMENTS

WO 2005097654 10/2005

* cited by examiner

*Primary Examiner* — Mark R Wendell

(57) ABSTRACT

The track-guided mobility seat is a mobility assistance device. The track-guided mobility seat is configured for use with a patient. The track-guided mobility seat comprises a seat, a guide system, and a rail. The guide system attaches the seat to the rail. The rail forms a track that controls the motion of the seat along the rail. The guide system moves the seat along the rail. The seat further comprises a reach extender that allows a patient to grasp an object that would otherwise be out of reach of the patient.

17 Claims, 6 Drawing Sheets

TRACK-GUIDED MOBILITY SEAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of furniture including stools for specified purposes, more specifically, a movably mounted stool. (A47C9/022)

SUMMARY OF INVENTION

The track-guided mobility seat is a mobility assistance device. The track-guided mobility seat is configured for use with a patient. The track-guided mobility seat comprises a seat, a guide system, and a rail. The guide system attaches the seat to the rail. The rail forms a track that controls the motion of the seat along the rail. The guide system moves the seat along the rail. The seat further comprises a reach extender that allows a patient to grasp an object that would otherwise be out of reach of the patient.

These together with additional objects, features and advantages of the track-guided mobility seat will be readily apparent to those of ordinary skill in the art upon reading the following detailed description of the presently preferred, but nonetheless illustrative, embodiments when taken in conjunction with the accompanying drawings.

In this respect, before explaining the current embodiments of the track-guided mobility seat in detail, it is to be understood that the track-guided mobility seat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the track-guided mobility seat.

It is therefore important that the claims be regarded as including such equivalent construction insofar as they do not depart from the spirit and scope of the track-guided mobility seat. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
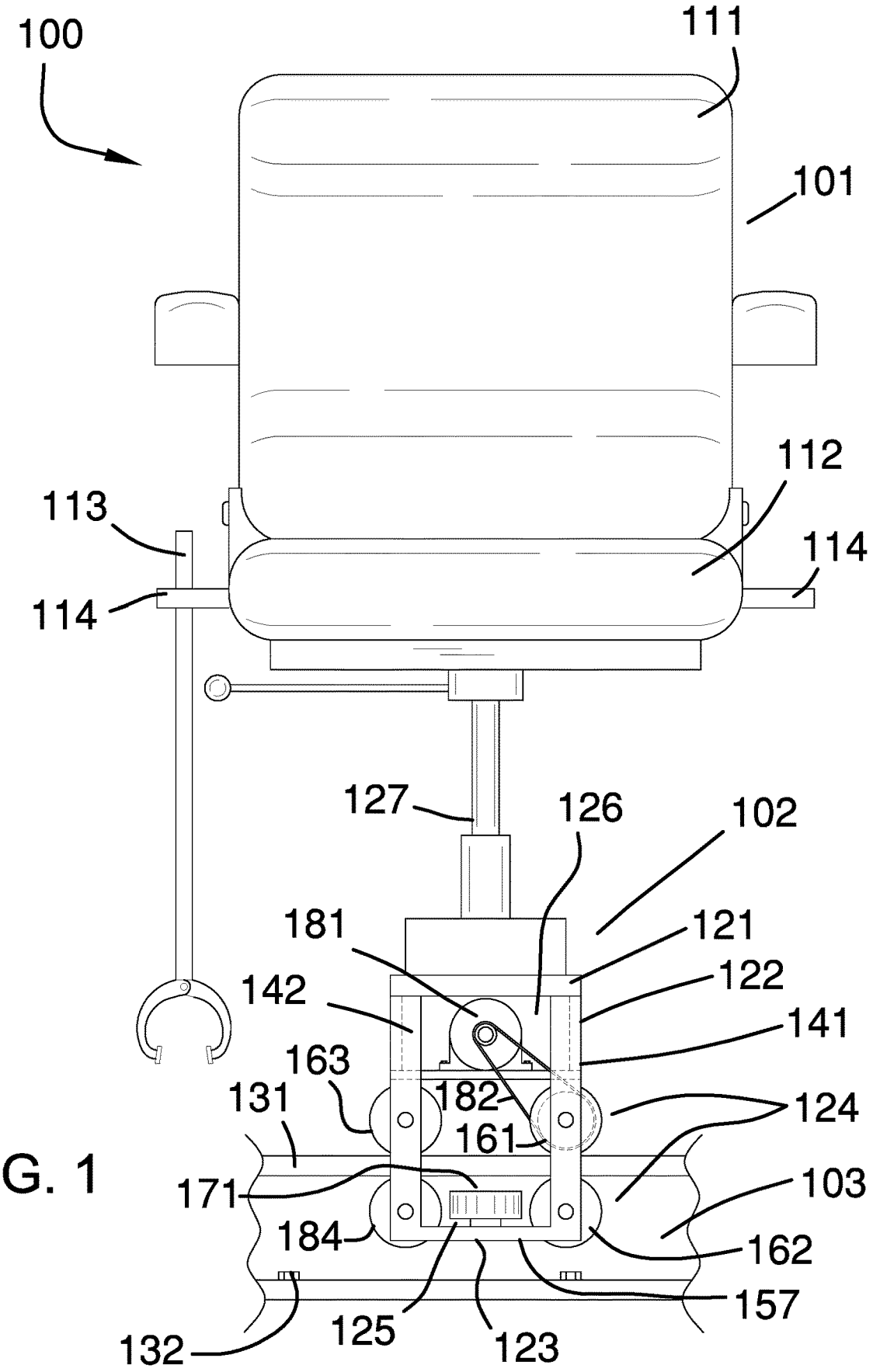
FIG. 1 is a front view of an embodiment of the disclosure.
Figure 2:
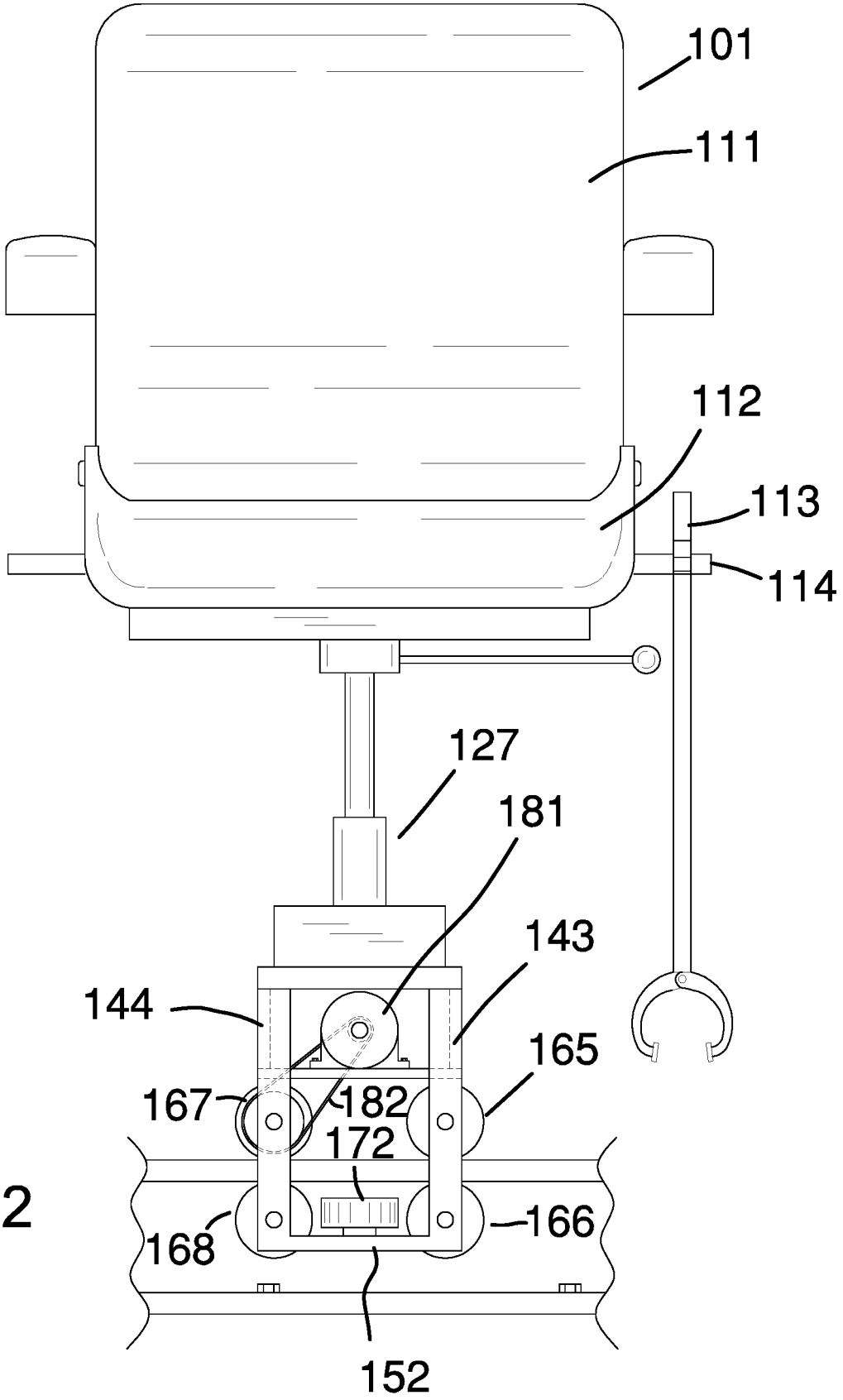
FIG. 2 is a rear view of an embodiment of the disclosure.
Figure 3:
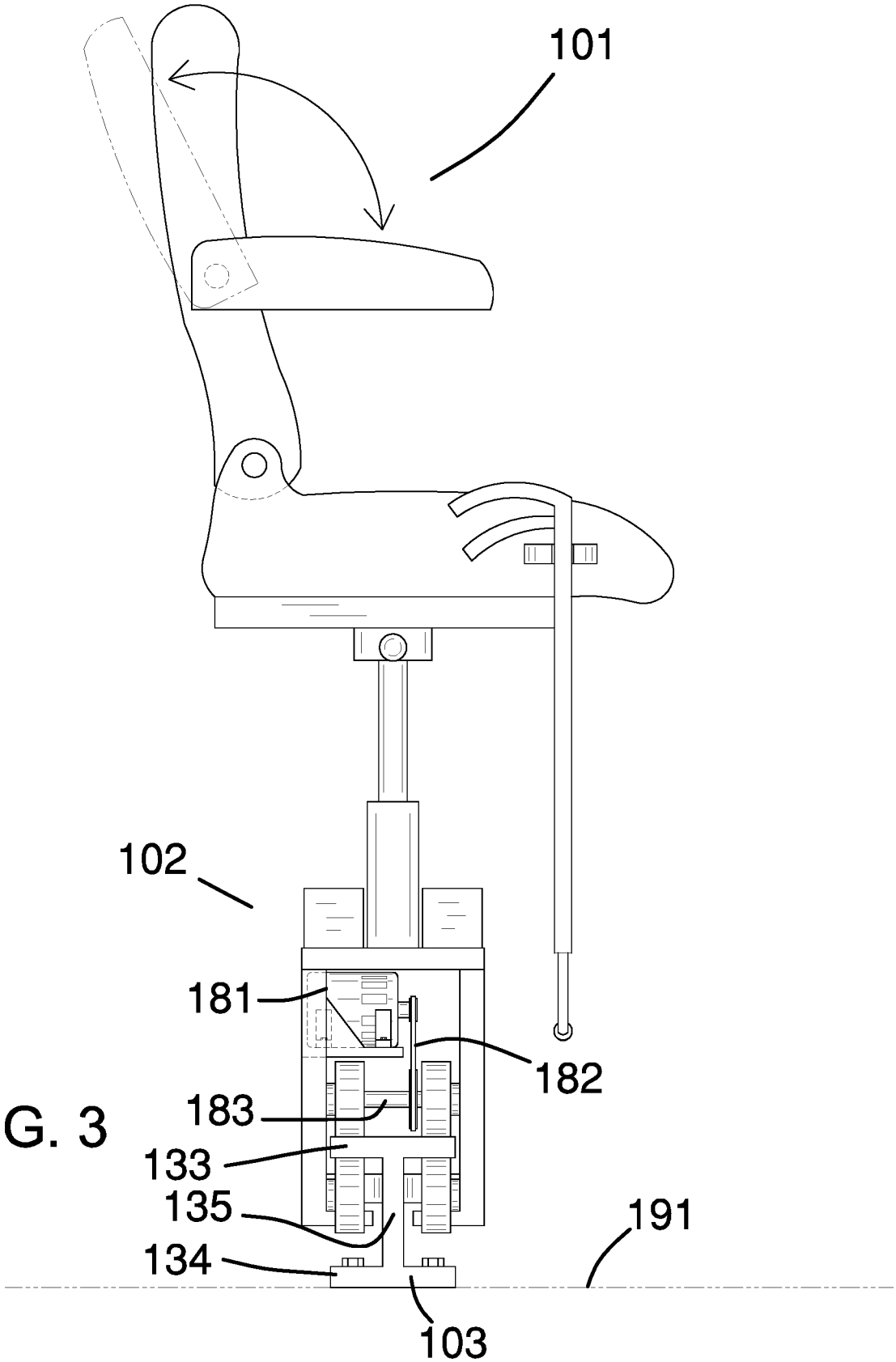
FIG. 3 is a side view of an embodiment of the disclosure.
Figure 4:
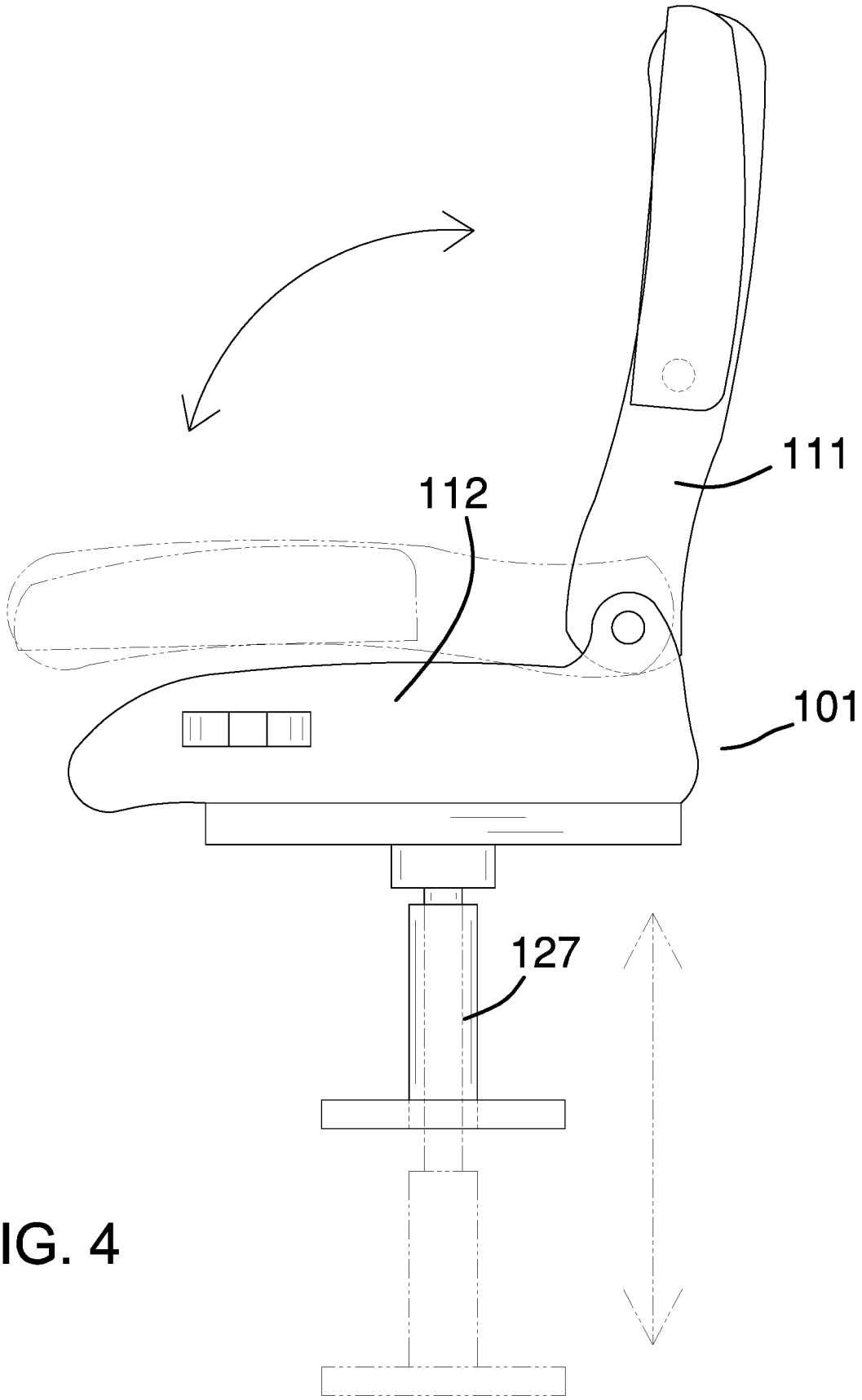
FIG. 4 is a reverse side view of an embodiment of the disclosure.
Figure 5:
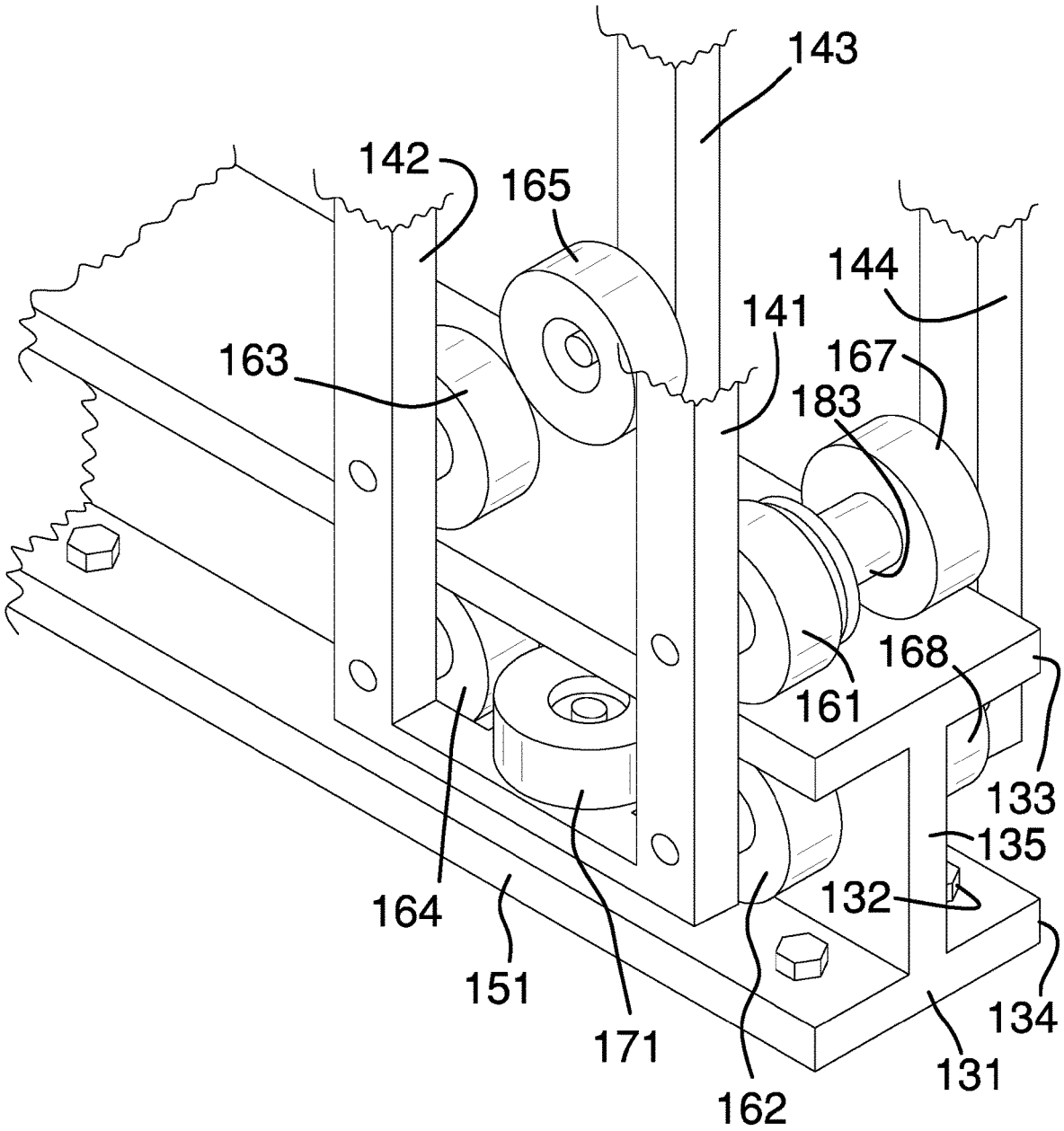
FIG. 5 is a detail view of an embodiment of the disclosure.
Figure 6:
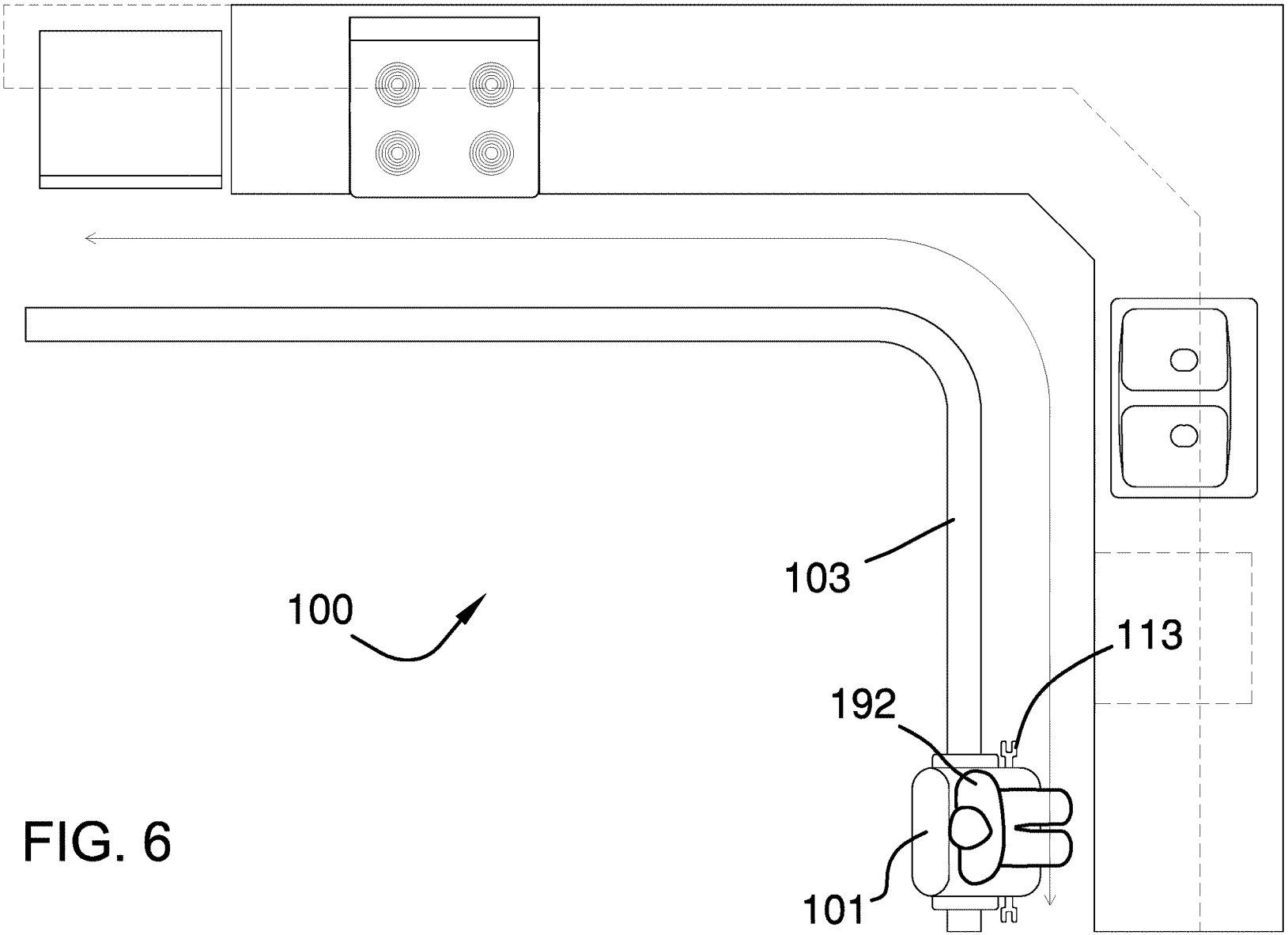
FIG. 6 is a top view of an embodiment of the disclosure.

Detailed reference will now be made to one or more potential embodiments of the disclosure, which are illustrated in FIGS. 1 through 6.

The track-guided mobility seat 100 (hereinafter invention) is a mobility assistance device. The invention 100 is configured for use with a patient 192. The invention 100 comprises a seat 101, a guide system 102, and a rail 103. The guide system 102 attaches the seat 101 to the rail 103. The rail 103 forms a track that controls the motion of the seat 101 along the rail 103. The guide system 102 moves the seat 101 along the rail 103. The seat 101 further comprises a reach extender 113 that allows a patient 192 to grasp an object that would otherwise be out of reach of the patient 192. The supporting surface 191 is defined elsewhere in this disclosure. The patient 192 is defined elsewhere in this disclosure.

The seat 101 is a mechanical structure. The patient 192 sits on the seat 101 during normal use of the invention 100. The seat 101 comprises a backrest 111 and a bench 112. The bench 112 attaches to the backrest 111. The backrest 111 is a mechanical structure that provides roughly vertical support the patient 192 to use while sitting in the seat 101. The use of a backrest 111 is well-known and documented in the furniture arts. The bench 112 is a mechanical structure that provides roughly horizontal support the patient 192 to use while sitting in the seat 101. The bench 112 is well-known and documented in the furniture arts.

The bench 112 further comprises a reach extender 113 and one or more clips 114. The reach extender 113 is an extension apparatus. The reach extender 113 extends the reach of the patient 192 such that the patient 192 does not have to leave the seat 101 to grasp an object. The reach extender 113 is a commercially available mechanical device commonly marketed as a reacher-grabber. Each of the one or more clips 114 is a commercially available fastening device. The clip 114 is further defined elsewhere in this disclosure. Each of the one or more clips 114 attaches the reach extender 113 to the bench 112 such that the reach extender 113 is stored within reach of the patient 192.

The rail 103 is a mechanical structure. The rail 103 forms a load path that transfers the load of the seat 101 and the guide system 102 to a supporting surface 191. The guide system 102 attaches to the rail 103 such that the rail 103 guides the horizontal motion of the seat 101 and the guide system 102. The rail 103 comprises one or more I-beams 131 and a plurality of bolts 132.

Each of the plurality of bolts 132 is a commercially available hardware item. The plurality of bolts 132 are used to bolt the one or more I-beams 131 to the supporting surface 191.

Each of the one or more I-beams 131 is an I-beam. Each of the one or more I-beams 131 are laid end to end such that the one or more I-beams 131 forms a track that guides the motion of the guide system 102 when the invention 100 is in use. The I-beam is a well-known and documented structure. Each of the one or more I-beams 131 comprises a superior flange 133, an inferior flange 134, and a web 135.

The superior flange 133 is a horizontal surface formed by a first flange of the one or more I-beams 131. The superior flange 133 forms the superior horizontal surface of the one or more I-beams 131. The superior flange 133 attaches to the web 135. The inferior flange 134 is a horizontal surface formed by a second flange of the seat 101. The inferior flange 134 forms the inferior horizontal surface of the seat 101. The inferior flange 134 attaches to the edge of the web 135 that is distal from the superior flange 133. The web 135 is a vertical surface formed between the superior flange 133 and the inferior flange 134. The web 135 gives the one or more I-beams 131 a characteristic "I" shape.

The guide system 102 moves the seat 101 along the track formed by the rail 103 such that the invention 100 moves the patient 192 along the track formed by the rail 103. The guide system 102 is a mechanical device. The guide system 102 attaches the seat 101 to the rail 103. The guide system 102 forms a load path that transfers the load of the seat 101 to the rail 103. The guide system 102 provides the motive forces that move the seat 101 in a horizontal direction along the track formed by the rail 103. The guide system 102 provides the motive forces that raises and reduces the vertical elevation of the seat 101 relative to the rail 103. The guide system 102 comprises a superior plate 121, a plurality of stanchions 122, a plurality of cross beams 123, a plurality of horizontal wheels 124, a plurality of vertical wheels 125, a drive system 126, and a pneumatic mount 127.

The superior plate 121 is a rectangular disk-shaped structure. The plurality of stanchions 122 attach to the superior plate 121. The plurality of cross beams 123 attach to the plurality of stanchions 122. The drive system 126 attaches to the superior plate 121. The pneumatic mount 127 attaches to the superior plate 121. The superior plate 121 transfers the load path of the seat 101, the guide system 102, the drive system 126, and the pneumatic mount 127 to the plurality of stanchions 122.

Each plurality of stanchions 122 is a vertically oriented load-bearing structure. Each of the plurality of stanchions 122 is a prism-shaped shaft. Each of the plurality of stanchions 122 attaches to the superior plate 121 in the manner of a cantilever. Each of the plurality of stanchions 122 are identical. The plurality of stanchions 122 forms a load path that transfers the load carried by the superior plate 121 to the plurality of horizontal wheels 124. The plurality of horizontal wheels 124 attach to the plurality of stanchions 122. The plurality of stanchions 122 elevates the superior plate 121 above the rail 103 such that the drive system 126 and the pneumatic mount 127 are elevated above the rail 103. The plurality of stanchions 122 comprises a first stanchion 141, a second stanchion 142, a third stanchion 143, and a fourth stanchion 144.

The first stanchion 141 is a stanchion selected from the plurality of stanchions 122. The first stanchion 141 attaches to a corner of the inferior surface of the superior plate 121. The second stanchion 142 is a stanchion selected from the plurality of stanchions 122. The second stanchion 142 attaches to a corner of the inferior surface of the superior plate 121. The third stanchion 143 is a stanchion selected from the plurality of stanchions 122. The third stanchion 143 attaches to a corner of the inferior surface of the superior plate 121. The fourth stanchion 144 is a stanchion selected from the plurality of stanchions 122. The fourth stanchion 144 attaches to a corner of the inferior surface of the superior plate 121.

Each of the plurality of cross beams 123 is a prism-shaped shaft. Each of the plurality of cross beams 123 are identical. The plurality of vertical wheels 125 attach to the plurality of cross beams 123. Each of the plurality of cross beams 123 attaches a primary stanchion selected from the plurality of stanchions 122 to a secondary stanchion selected from the plurality of cross beams 123. Each of the plurality of cross beams 123 act as a brace that links the selected stanchions such that the relative positions of the selected stanchions are fixed relative to each other. The plurality of cross beams 123 comprises a first cross beam 151 and a second cross beam 152.

The first cross beam 151 is a shaft selected from the plurality of cross beams 123. The first cross beam 151 attaches the free end of the first stanchion 141 to the free end of the second stanchion 142. The second cross beam 152 is a shaft selected from the plurality of cross beams 123. The second cross beam 152 attaches the free end of the third stanchion 143 to the free end of the fourth stanchion 144.

Each of the plurality of horizontal wheels 124 is a wheel that attaches to a stanchion selected from the plurality of stanchions 122 such that the selected wheel rolls freely relative to the selected stanchion. The center of rotation of each of the plurality of horizontal wheels 124 are horizontally oriented.

A first subset of wheels selected from the plurality of horizontal wheels 124 rest on the superior surface of the superior flange 133 of the one or more I-beams 131 of the rail 103 such that the load path carried by the superior plate 121 and the plurality of stanchions 122 is transferred to the rail 103. A second subset of wheels selected from the plurality of horizontal wheels 124 are positioned underneath the superior flange 133 of the one or more I-beams 131 of the rail 103 such that the plurality of horizontal wheels 124 vertically traps the superior flange 133 of the one or more I-beams 131 between the first subset of wheels selected from the plurality of horizontal wheels 124 and the second subset of wheels selected from the plurality of horizontal wheels 124.

The plurality of horizontal wheels 124 comprises a first horizontal wheel 161, a second horizontal wheel 162, a third horizontal wheel 163, a fourth horizontal wheel 164, a fifth horizontal wheel 165, a sixth horizontal wheel 166, a seventh horizontal wheel 167, and an eighth horizontal wheel 168.

The first horizontal wheel 161 is a rotating wheel that attaches to the first stanchion 141 such that the center of rotation of the first horizontal wheel 161 is horizontally oriented. The second horizontal wheel 162 is a rotating wheel that attaches to the first stanchion 141 such that the center of rotation of the second horizontal wheel 162 is horizontally oriented.

The third horizontal wheel 163 is a rotating wheel that attaches to the second stanchion 142 such that the center of rotation of the third horizontal wheel 163 is horizontally oriented. The fourth horizontal wheel 164 is a rotating wheel that attaches to the second stanchion 142 such that the center of rotation of the fourth horizontal wheel 164 is horizontally oriented.

The fifth horizontal wheel 165 is a rotating wheel that attaches to the third stanchion 143 such that the center of rotation of the fifth horizontal wheel 165 is horizontally oriented. The sixth horizontal wheel 166 is a rotating wheel that attaches to the third stanchion 143 such that the center of rotation of the sixth horizontal wheel 166 is horizontally oriented.

The seventh horizontal wheel 167 is a rotating wheel that attaches to the fourth stanchion 144 such that the center of rotation of the seventh horizontal wheel 167 is horizontally oriented. The eighth horizontal wheel 168 is a rotating wheel that attaches to the fourth stanchion 144 such that the center of rotation of the eighth horizontal wheel 168 is horizontally oriented.

Each of the plurality of vertical wheels 125 is a wheel that attaches to a shaft selected from the plurality of cross beams 123 such that the selected wheel rolls freely relative to the selected stanchion. The center of rotation of each of the plurality of vertical wheels 125 are vertically oriented. Each of the plurality of vertical wheels 125 are positioned underneath the plurality of stanchions 122. The plurality of vertical wheels 125 are positioned on each side of the web 135 of the one or more I-beams 131 such that the plurality of vertical wheels 125 prevents the guide system 102 from slipping laterally off the rail 103. The plurality of vertical wheels 125 comprises a first vertical wheel 171 and a second vertical wheel 172.

The first vertical wheel 171 is a rotating wheel that attaches to the first cross beam 151 such that the center of rotation of the first vertical wheel 171 is vertically oriented. The second vertical wheel 172 is a rotating wheel that attaches to the second cross beam 152 such that the center of rotation of the second vertical wheel 172 is vertically oriented.

The drive system 126 is an electrically powered transmission. The drive system 126 provides the motive forces required to move the seat 101 and the guide system 102 along the track formed by the rail 103. The drive system 126 comprises an electric motor 181, a belt 182, and a drive axle 183.

The electric motor 181 is an electrical device that converts electrical energy into rotational energy. The electric motor 181 rotates the first horizontal wheel 161 and the seventh horizontal wheel 167 such that the first horizontal wheel 161 and the seventh horizontal wheel 167 transfer the motive forces that move the guide system 102 along the rail 103. The drive axle 183 is an axle that rigidly attaches the first horizontal wheel 161 to the seventh horizontal wheel 167 such that the first horizontal wheel 161 and the seventh horizontal wheel 167 rotate in unison. The belt 182 is a continuous loop structure that transfers the rotation of the electric motor 181 to the drive axle 183 such that the rotation of the electric motor 181 will rotate the drive axle 183 to drive the first horizontal wheel 161 and the seventh horizontal wheel 167.

It shall be noted that electric motor 181 is in communication with a control system that controls the output of the electric motor 181. It shall be further noted that said control system could be mounted anywhere with respect to the invention 100, and could be in wireless communication. A voice-recognition capability, remote control, or even a mobile phone app could be used in order to provide a hands-free or wireless capability for the control system to direct all aspects of the invention 100. Alternatively, the control system could simply be a few buttons or switches that an end user would have access to while using the invention 100.

The pneumatic mount 127 is a mechanical device that attaches the bench 112 of the seat 101 to the superior plate 121 of the guide system 102. The pneumatic mount 127 is an adjustable device such that the elevation of the bench 112 is adjustable.

The following definitions were used in this disclosure:

Backrest: As used in this disclosure, a backrest is a vertical or vertically canted supporting surface formed in a chair or seat.

Bench: As used in this disclosure, a bench is a horizontal supporting surface formed by a chair.

Cant: As used in this disclosure, a cant is an angular deviation from one or more reference lines (or planes) such as a vertical line (or plane) or a horizontal line (or plane).

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Chair: As used in this disclosure, a chair is a structure that a person can sit on. Seat is a common synonym for a chair.

Clip: As used in this disclosure, a clip is a fastener that attaches to an object by gripping or clasping the object. A clip is typically spring loaded.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Drive: As used in this disclosure, a drive is a mechanism or a device that transmits a motive force from a first device or object to a second device or object with the objective or operating the second object.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interaction between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Extension Apparatus: As used in this disclosure, an extension apparatus is a mechanical structure that is used to extend or bridge the reach between any two objects.

Fluid: As used in this disclosure, a fluid refers to a state of matter wherein the matter is capable of flow and takes the shape of a container it is placed within. The term fluid commonly refers to a liquid or a gas.

Force of Gravity: As used in this disclosure, the force of gravity refers to a vector that indicates the direction of the pull of gravity on an object at or near the surface of the earth.

Gas: As used in this disclosure, a gas refers to a state (phase) of matter that is fluid and that fills the volume of the structure that contains it. Stated differently, the volume of a gas always equals the volume of its container.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

I-Beam: As used in this disclosure, an I-beam is a beam, generally made of iron or steel, which has a cross-section that forms an "I" shape. The I-beam is a well-known and commercially available beam. An I-beam comprises a first flange, a second flange, and a web.

Inferior: As used in this disclosure, the term inferior refers to a directional reference that is parallel to and in the same direction as the force of gravity when an object is positioned or used normally.

Lateral: As used in this disclosure, the term lateral refers to the movement of an object that is perpendicular to the primary sense of direction of an object and parallel to the horizontal plane (or perpendicular to the vertical plane). Lateral movement is always perpendicular to the anterior-posterior axis. Lateral movement is often called sideways movement.

Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Mobility Assistance Device: As used in this disclosure, a mobility assistance device is a mechanical device used to help patients with limited mobility to move.

Motor: As used in this disclosure, a motor refers to the method of transferring energy from an external power source into rotational mechanical energy.

Mount: As used in this disclosure, a mount is a mechanical structure that attaches or incorporates an object into a load path.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

Openwork: As used in this disclosure, the term open work is used to describe a structure, often a surface, which is formed with one or more openings that allow for visibility and fluid flow through the structure. Wrought work and meshes are forms of openwork.

Patient: As used in this disclosure, a patient is a person who is designated to receive a medical treatment, therapy or service. The term patient may be extended to an animal when used within the context of the animal receiving veterinary treatment or services.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board or a plank.

Pneumatic: As used in this disclosure, pneumatic refers to a device wherein the movement of the device is powered or controlled using a fluid under pressure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rail: As used in this disclosure, a rail is a continuous structure that forms a track that is used to guide the motion of an object.

Reach: As used in this disclosure, reach refers to a span of distance between any two objects.

Roughly: As used in this disclosure, roughly refers to a comparison between two objects. Roughly means that the difference between one or more parameters of the two compared are not significantly different.

Seat: As used in this disclosure, a seat is a structure that a person can sit on. Chair is a common synonym for a seat.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Track: As used in this disclosure, a track is a structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Transmission: As used in this disclosure, a transmission is a device that transmits the energy of motion from a first location to a second location.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction. Wheels are often further defined with a rim and spokes. Spokes are also commonly referred to as a wheel disk.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A mobility assistance device comprising:
a seat, a guide system, and a rail;
wherein the guide system attaches the seat to the rail;
wherein the mobility assistance device is configured for use with a patient;
wherein the rail forms a track that controls the motion of the seat along the rail;
wherein the guide system moves the seat along the rail;
wherein the seat further comprises a reach extender that allows the patient to grasp an object;
wherein the patient is configured to sit on the seat;
wherein the vertical elevation of the seat is adjustable;
wherein the guide system forms a load path that transfers the load of the seat to the rail;
wherein the rail forms a track;
wherein the rail forms a load path that transfers the load of the seat and the guide system to a supporting surface;
wherein the guide system provides a motive force that moves the seat in a horizontal direction along the track formed by the rail;
wherein the guide system attaches to the rail such that the rail guides the horizontal motion of the seat and the guide system;
wherein the guide system provides the motive forces that raises and reduces the vertical elevation of the seat relative to the rail;
wherein the guide system comprises a superior plate, a plurality of stanchions, a plurality of cross beams, a plurality of horizontal wheels, a plurality of vertical wheels, a drive system, and a pneumatic mount;
wherein the superior plate is a rectangular disk-shaped structure;
wherein the plurality of stanchions attach to the superior plate;
wherein the plurality of cross beams attach to the plurality of stanchions;
wherein the drive system attaches to the superior plate;
wherein the pneumatic mount attaches to the superior plate;
wherein the superior plate transfers the load path of the seat, the guide system, the drive system, and the pneumatic mount to the plurality of stanchions.

2. The mobility assistance device according to claim 1
wherein the seat comprises a backrest and a bench;
wherein the bench attaches to the backrest.

3. The mobility assistance device according to claim 2
wherein the bench further comprises a reach extender and one or more clips;
wherein the reach extender is an extension apparatus;
wherein each of the one or more clips is a fastening device;
wherein each of the one or more clips attaches the reach extender to the bench such that the reach extender is stored within reach of the patient.

4. The mobility assistance device according to claim 3
wherein the rail comprises one or more I-beams and a plurality of bolts;
wherein the plurality of bolts bolt the one or more I-beams to the supporting surface.

5. The mobility assistance device according to claim 4
wherein each of the plurality of bolts is a hardware item;
wherein each of the one or more I-beams is an I-beam;
wherein each of the one or more I-beams are laid end to end to form the track that guides the motion of the guide system.

6. The mobility assistance device according to claim 5
wherein each of the one or more I-beams comprises a superior flange, an inferior flange, and a web;
wherein the superior flange attaches to the web;
wherein the inferior flange attaches to the edge of the web that is distal from the superior flange.

7. The mobility assistance device according to claim 6
wherein the superior flange is a horizontal surface formed by a first flange of the one or more I-beams;
wherein the superior flange forms the superior horizontal surface of the one or more I-beams;
wherein the inferior flange is a horizontal surface formed by a second flange of the seat;

wherein the inferior flange forms the inferior horizontal surface of the seat;

wherein the web is a vertical surface formed between the superior flange and the inferior flange.

8. The mobility assistance device according to claim 7 wherein each plurality of stanchions is a vertically oriented load-bearing structure;

wherein each of the plurality of stanchions is a prism-shaped shaft;

wherein each of the plurality of stanchions attaches to the superior plate in the manner of a cantilever;

wherein each of the plurality of stanchions are identical;

wherein the plurality of stanchions forms a load path that transfers the load carried by the superior plate to the plurality of horizontal wheels;

wherein the plurality of horizontal wheels attach to the plurality of stanchions;

wherein the plurality of stanchions elevates the superior plate above the rail such that the drive system and the pneumatic mount are elevated above the rail.

9. The mobility assistance device according to claim 8 wherein each of the plurality of cross beams is a prism-shaped shaft;

wherein each of the plurality of cross beams are identical;

wherein the plurality of vertical wheels attach to the plurality of cross beams;

wherein each of the plurality of cross beams attaches a primary stanchion selected from the plurality of stanchions to a secondary stanchion selected from the plurality of cross beams;

wherein each of the plurality of cross beams act as a brace that links the selected stanchions such that the relative positions of the selected stanchions are fixed relative to each other.

10. The mobility assistance device according to claim 9 wherein each of the plurality of horizontal wheels is a wheel that attaches to a stanchion selected from the plurality of stanchions such that the selected wheel rolls freely relative to the selected stanchion;

wherein the center of rotation of each of the plurality of horizontal wheels are horizontally oriented;

wherein a first subset of wheels selected from the plurality of horizontal wheels rest on the superior surface of the superior flange of the one or more I-beams of the rail such that the load path carried by the superior plate and the plurality of stanchions is transferred to the rail;

wherein a second subset of wheels selected from the plurality of horizontal wheels are positioned underneath the superior flange of the one or more I-beams of the rail such that the plurality of horizontal wheels vertically traps the superior flange of the one or more I-beams between the first subset of wheels selected from the plurality of horizontal wheels and the second subset of wheels selected from the plurality of horizontal wheels.

11. The mobility assistance device according to claim 10 wherein each of the plurality of vertical wheels is a wheel that attaches to a shaft selected from the plurality of cross beams such that the selected wheel rolls freely relative to the selected stanchion;

wherein the center of rotation of each of the plurality of vertical wheels are vertically oriented;

wherein each of the plurality of vertical wheels are positioned underneath the plurality of stanchions;

wherein the plurality of vertical wheels are positioned on each side of the web of the one or more I-beams such that the plurality of vertical wheels prevents the guide system from slipping laterally off the rail.

12. The mobility assistance device according to claim 11 wherein the drive system is an electrically powered transmission;

wherein the drive system provides the motive forces required to move the seat and the guide system along the track formed by the rail;

wherein the pneumatic mount is a mechanical device that attaches the bench of the seat to the superior plate of the guide system;

wherein the pneumatic mount is an adjustable device such that the elevation of the bench is adjustable.

13. The mobility assistance device according to claim 12 wherein the plurality of stanchions comprises a first stanchion, a second stanchion, a third stanchion, and a fourth stanchion;

wherein the first stanchion is a stanchion selected from the plurality of stanchions;

wherein the first stanchion attaches to a corner of the inferior surface of the superior plate;

wherein the second stanchion is a stanchion selected from the plurality of stanchions;

wherein the second stanchion attaches to a corner of the inferior surface of the superior plate;

wherein the third stanchion is a stanchion selected from the plurality of stanchions;

wherein the third stanchion attaches to a corner of the inferior surface of the superior plate;

wherein the fourth stanchion is a stanchion selected from the plurality of stanchions;

wherein the fourth stanchion attaches to a corner of the inferior surface of the superior plate.

14. The mobility assistance device according to claim 13 wherein the plurality of cross beams comprises a first cross beam and a second cross beam;

wherein the first cross beam is a shaft selected from the plurality of cross beams;

wherein the first cross beam attaches the free end of the first stanchion to the free end of the second stanchion;

wherein the second cross beam is a shaft selected from the plurality of cross beams;

wherein the second cross beam attaches the free end of the third stanchion to the free end of the fourth stanchion.

15. The mobility assistance device according to claim 14 wherein the plurality of horizontal wheels comprises a first horizontal wheel, a second horizontal wheel, a third horizontal wheel, a fourth horizontal wheel, a fifth horizontal wheel, a sixth horizontal wheel, a seventh horizontal wheel, and an eighth horizontal wheel;

wherein the first horizontal wheel is a rotating wheel that attaches to the first stanchion such that the center of rotation of the first horizontal wheel is horizontally oriented;

wherein the second horizontal wheel is a rotating wheel that attaches to the first stanchion such that the center of rotation of the second horizontal wheel is horizontally oriented;

wherein the third horizontal wheel is a rotating wheel that attaches to the second stanchion such that the center of rotation of the third horizontal wheel is horizontally oriented;

wherein the fourth horizontal wheel is a rotating wheel that attaches to the second stanchion such that the center of rotation of the fourth horizontal wheel is horizontally oriented;

wherein the fifth horizontal wheel is a rotating wheel that attaches to the third stanchion such that the center of rotation of the fifth horizontal wheel is horizontally oriented;

wherein the sixth horizontal wheel is a rotating wheel that attaches to the third stanchion such that the center of rotation of the sixth horizontal wheel is horizontally oriented;

wherein the seventh horizontal wheel is a rotating wheel that attaches to the fourth stanchion such that the center of rotation of the seventh horizontal wheel is horizontally oriented;

wherein the eighth horizontal wheel is a rotating wheel that attaches to the fourth stanchion such that the center of rotation of the eighth horizontal wheel is horizontally oriented.

16. The mobility assistance device according to claim 15 wherein the plurality of vertical wheels comprises a first vertical wheel and a second vertical wheel;

wherein the first vertical wheel is a rotating wheel that attaches to the first cross beam such that the center of rotation of the first vertical wheel is vertically oriented;

wherein the second vertical wheel is a rotating wheel that attaches to the second cross beam such that the center of rotation of the second vertical wheel is vertically oriented.

17. The mobility assistance device according to claim 16 wherein the drive system comprises an electric motor, a belt, and a drive axle;

wherein the electric motor is an electrical device that converts electrical energy into rotational energy;

wherein the electric motor rotates the first horizontal wheel and the seventh horizontal wheel such that the first horizontal wheel and the seventh horizontal wheel transfer the motive forces that move the guide system along the rail;

wherein the drive axle is an axle that rigidly attaches the first horizontal wheel to the seventh horizontal wheel such that the first horizontal wheel and the seventh horizontal wheel rotate in unison;

wherein the belt is a continuous loop structure that transfers the rotation of the electric motor to the drive axle such that the rotation of the electric motor will rotate the drive axle to drive the first horizontal wheel and the seventh horizontal wheel.

* * * * *